US007874240B2

(12) United States Patent
Akhavan

(10) Patent No.: US 7,874,240 B2
(45) Date of Patent: Jan. 25, 2011

(54) FIREARM OPERATING MECHANISMS AND METHODS

(75) Inventor: Brian Akhavan, 1705 Princeton La., West Fargo, ND (US) 58078

(73) Assignee: Brian Akhavan, West Fargo, ND (US)

( * ) Notice: Subject to any disclaimer, the term of this patent is extended or adjusted under 35 U.S.C. 154(b) by 581 days.

(21) Appl. No.: 11/821,792

(22) Filed: Jun. 25, 2007

(65) Prior Publication Data

US 2010/0236395 A1 Sep. 23, 2010

Related U.S. Application Data

(60) Provisional application No. 60/815,957, filed on Jun. 23, 2006.

(51) Int. Cl.
*F41A 5/24* (2006.01)

(52) U.S. Cl. ..... 89/179

(58) Field of Classification Search ..... 89/14.05, 89/178, 179, 191.01, 192, 193; 42/25, 46, 42/47

See application file for complete search history.

(56) References Cited

U.S. PATENT DOCUMENTS

| | | | | |
|---|---|---|---|---|
| 2,951,424 A | | 9/1960 | Stoner | |
| 3,198,076 A | * | 8/1965 | Stoner | 89/128 |
| 3,236,155 A | | 2/1966 | Sturtevant | |
| 3,246,567 A | | 4/1966 | Miller | |
| 3,318,192 A | | 5/1967 | Miller et al. | |
| 3,618,457 A | | 11/1971 | Miller | |
| 3,675,534 A | | 7/1972 | Beretta | |
| 3,742,636 A | | 7/1973 | Dealy et al. | |
| 3,848,510 A | | 11/1974 | Wolpert | |
| 3,985,062 A | * | 10/1976 | Hupp et al. | 89/159 |
| 3,990,346 A | | 11/1976 | Irwin | |
| 4,358,986 A | | 11/1982 | Giorgio | |
| 4,563,937 A | * | 1/1986 | White | 89/185 |
| 4,756,228 A | * | 7/1988 | Rath | 89/191.01 |
| 4,765,224 A | * | 8/1988 | Morris | 89/191.01 |
| 4,930,399 A | | 6/1990 | Trevor, Jr. | |
| 5,448,940 A | | 9/1995 | Schuetz et al. | |
| 5,710,389 A | | 1/1998 | Canaday | |
| 5,827,991 A | | 10/1998 | Predazzer | |

(Continued)

FOREIGN PATENT DOCUMENTS

WO WO-2008094177 A2 8/2008

OTHER PUBLICATIONS

"International Application Serial No. PCT/US07/14704, Search Report mailed Jul. 18, 2008", 4 pgs.

(Continued)

*Primary Examiner*—Bret Hayes
(74) *Attorney, Agent, or Firm*—Schwegman, Lundberg & Woessner, P.A.

(57) ABSTRACT

The present invention is a direct impingement gas operated firearm, having a longitudinally translatable bolt and a rearward locking mechanism coupled to the bolt. The rearward locking mechanism includes a locking lug, laterally shiftable by gas means from a locked position to an unlocked position, and a reinforcement, fixed with respect to the bolt. In the locked position the lug interferes with the reinforcement such that the bolt is restrained from moving longitudinally, and in the unlocked position the bolt is free to longitudinally translate within the firearm.

20 Claims, 5 Drawing Sheets

U.S. PATENT DOCUMENTS

| | | | | |
|---|---|---|---|---|
| 6,481,144 | B1 * | 11/2002 | Chee et al. | 42/76.01 |
| 7,131,228 | B2 * | 11/2006 | Hochstrate et al. | 42/75.01 |
| 7,418,898 | B1 | 9/2008 | Desomma | |
| 7,596,900 | B2 | 10/2009 | Robinson et al. | |
| 2002/0026739 | A1 | 3/2002 | Murello et al. | |
| 2005/0262752 | A1 | 12/2005 | Robinson et al. | |
| 2006/0048430 | A1 | 3/2006 | Crandall et al. | |
| 2009/0000173 | A1 | 1/2009 | Robinson et al. | |
| 2009/0007477 | A1 | 1/2009 | Robinson et al. | |
| 2009/0031605 | A1 | 2/2009 | Robinson et al. | |
| 2009/0031606 | A1 | 2/2009 | Robinson et al. | |
| 2009/0031607 | A1 | 2/2009 | Robinson et al. | |

OTHER PUBLICATIONS

"International Application Serial No. PCT/US07/14704, Written Opinion mailed Jul. 18, 2008", 5 pgs.
"M16A1 & M16A2 Rifle Markmanship Manual (FM 23-9)", United States Department of the Army, (Jul. 3, 1989), 305 pgs.

* cited by examiner

FIREARM OPERATING MECHANISMS AND METHODS

RELATED APPLICATION

The present application claims the benefit of U.S. Provisional Application No. 60/815,957 filed Jun. 23, 2006, which is incorporated herein in its entirety by reference.

FIELD OF THE INVENTION

The present invention relates generally to firearms. More specifically, the present invention is an improved direct impingement gas-operated firing mechanism for a firearm.

BACKGROUND OF THE INVENTION

Rifles belonging to the M16 family, such as M16, AR-15, and their variants, are gas-operated, selective fire, magazine fed rifles. A unique feature to these rifles is the direct impingement gas-operation system used to cycle the firing action. In traditional gas-operated reloading mechanisms, a portion of the high-pressure gas from a fired cartridge is used to operate a piston and rod arrangement which prepares the firearm for the next firing cycle. One drawback to a traditional gas-operated mechanism is the added complexity and weight of the piston and rod. Further, the use of a piston and rod arrangement may increase the recoil of the firearm. In a direct impingement gas-operation system as found on M16-type rifles, the piston and rod arrangement is removed, and high-pressure gas is ported from the barrel directly back to the firing mechanism to prepare the firearm for the next firing cycle.

More specifically, M16-type direct impingement systems work as follows. Upon firing a cartridge, high-temperature, high-pressure gas follows the exiting projectile down the barrel. The barrel includes a small port, coupled to a tube which runs parallel to the barrel. A portion of the gas from the fired cartridge travels into the port and tube. The other end of the tube enters the upper receiver of the rifle, where it enters the bolt carrier key, or gas key. The gas key is coupled to the bolt carrier, and the gas key includes an internal port to allow the high-pressure gas to flow into the bolt carrier. Once the gas enters the bolt carrier, it expands, and the pressure from the gas urges the bolt carrier away from the barrel. However, the bolt initially resists the bolt carrier's movement, as the bolt is temporarily locked to the barrel for firing. The urging of the bolt carrier acts on a cam pin, which causes the bolt to rotate so at to be unlocked from the barrel. The bolt carrier and bolt then translate away from the barrel, extracting the empty cartridge, and compressing the buffer return spring located in the buttstock. The forward movement of the bolt and bolt carrier off the return spring first strips a fresh cartridge from the ammunition magazine and, on the final stage of the movement, rotates the bolt to lock it into the barrel, ready for firing.

A forward assist device is optionally used on M16-type type rifles. This is a back-up device that engages serrations on the right side of the bolt carrier to manually push the bolt carrier forward in the event the force from the return spring is insufficient to push the bolt carrier forward into a locked position. A common reason for the return spring not being able to move the bolt carrier into a locked position is from fouling or debris inside the upper receiver or breech. As the rifle will not fire unless the bolt is locked against the barrel and the bolt carrier is in its forwardmost position, the forward assist is necessary to ensure normal operation of the rifle in all conditions. The bolt carrier and the bolt itself may be chrome-plated to resist debris build-up. The "T"-shaped charging handle is located at the rear of the receiver, above the buttstock, and does not reciprocate when gun is fired. The charging handle is configured to hold the bolt in an unlocked position for cleaning or maintenance.

The firing and locking mechanisms in M16-type rifles is contained primarily in the upper receiver, which is removably coupled to the other components of the firearm such as the lower receiver, buttstock, and barrel.

Some advantages of direct impingement systems over other gas-operated systems is increased simplicity, lighter weight, reduced recoil, smoother operation, and reduced cost. One disadvantage of direct impingement systems is that the breech of the firearm may become fouled more easily, as the gasses act directly on the bolt. The gasses that operate the firing and locking mechanism contain impurities such as carbon and metal that become deposited on the moving parts of the firing mechanism, which can lead to misfires and unreliable operation. Frequent cleaning of the breech, the bolt, the bolt carrier, and the firing pin is necessary to remove carbon and metal deposits.

Even with frequent cleaning, trouble-free operation of a direct impingement firearm is not guaranteed. Misfires still occur even with regular cleaning, due to external debris such as sand, mud, snow or water entering the breech. Each time a round is fired, the bolt unlocks and then re-locks, providing an opportunity for debris to enter. Operating conditions experienced during combat can expose the firearm to such external debris, at a time when reliable operation of the firearm is crucial.

A further disadvantage of M16-type rifles is the forward-placed, rotary locking mechanism. The multiple moving parts and complexity of this arrangement can lead to unreliable operation.

Previous solutions to the reliability problem of direct impingement firing mechanisms have been inadequate due to their complexity, cost, or ineffectiveness. Accordingly, there is a need in the industry for a simple, effective and reliable gas operating system.

SUMMARY OF THE INVENTION

In one embodiment, the present invention comprises a direct impingement gas operated firearm. The firearm comprises a longitudinally translatable bolt and a rearward locking mechanism coupled to the bolt. The rearward locking mechanism includes a locking lug, laterally shiftable by gas means from a locked position to an unlocked position, and a reinforcement, fixed with respect to the bolt. In the locked position the lug interferes with the reinforcement such that the bolt is restrained from moving longitudinally, and in the unlocked position the bolt is free to longitudinally translate within the firearm.

In one embodiment, the present invention comprises a rearward locking mechanism for a gas operated firearm. The rearward locking mechanism comprises a locking reinforcement fixed with respect to a bolt in the firearm and a locking lug slidably coupled to the bolt. The locking lug is moveable by gas means between a locked position wherein the lug is secured against the reinforcement such that movement of the bolt is prevented, and an unlocked position wherein the lug is clear of the reinforcement such that the bolt is free to translate along a longitudinal axis of the firearm.

In one embodiment, the present invention comprises a bolt for a direct impingement gas operated firearm. The bolt comprises an integrated rearward locking mechanism adapted to selectively maintain the bolt in a locked position or an unlocked position, an integrated extractor adapted to remove an empty ammunition cartridge from a breech of the firearm after firing, and one or more alignment features configured to maintain rotational alignment of the bolt during operation, wherein the bolt is translatable along a longitudinal axis of the firearm when the rearward locking mechanism is in the unlocked position.

In one embodiment, the present invention comprises a method of operation of a firearm. The method includes providing a bolt having an extractor, providing a locking mechanism having a shiftable locking lug, communicating a gas operating system with at least a portion of the locking mechanism, communicating a gas from a distal end of the barrel to the gas operating system, and shifting at least a portion of the locking mechanism from a locked position to an unlocked position with gas means.

BRIEF DESCRIPTION OF THE DRAWINGS

The present invention can be more completely understood and appreciated by referring to the following more detailed description of the presently preferred exemplary embodiments of the invention in conjunction with the accompanying drawings, of which.

DETAILED DESCRIPTION OF THE DRAWINGS

In the following detailed description of the present invention, numerous specific details are set forth in order to provide a thorough understanding of the present invention. However, it will be apparent to one skilled in the art that the present invention may be practiced without these specific details. In other instances, well-known methods, procedures, and components have not been described in detail so as to not unnecessarily obscure aspects of the present invention.

Figure 1:
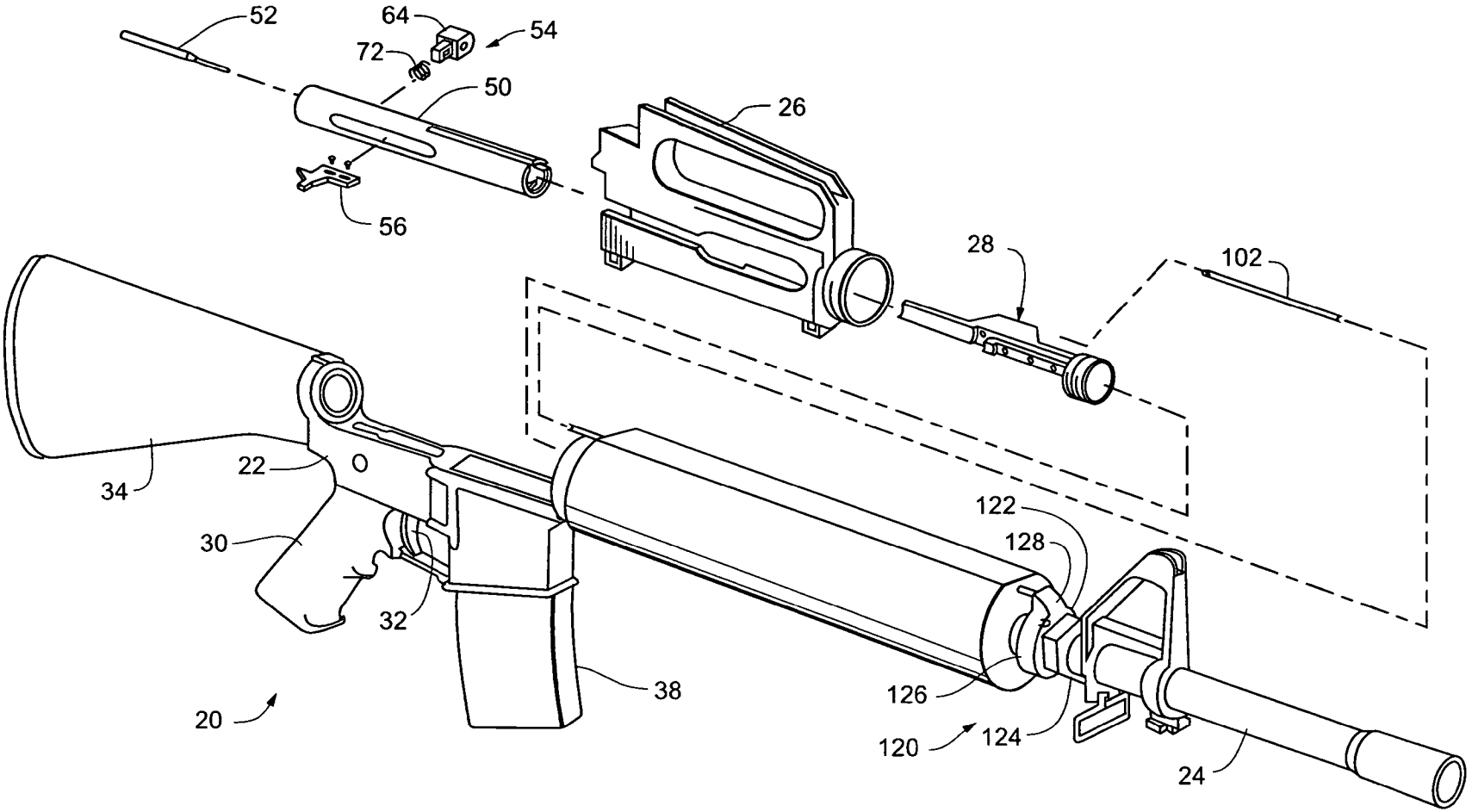
FIG. 1 is a perspective exploded view of a firearm according to one embodiment of the present invention.

Referring to FIG. 1, a firearm 20 is depicted, having a lower receiver 22, a barrel 24, an upper receiver 26, and a gas operating system 28. Lower receiver 22 comprises a grip 30, a trigger assembly 32, a buttstock 34 having an action spring, and an ammunition magazine 38.

Figure 2:
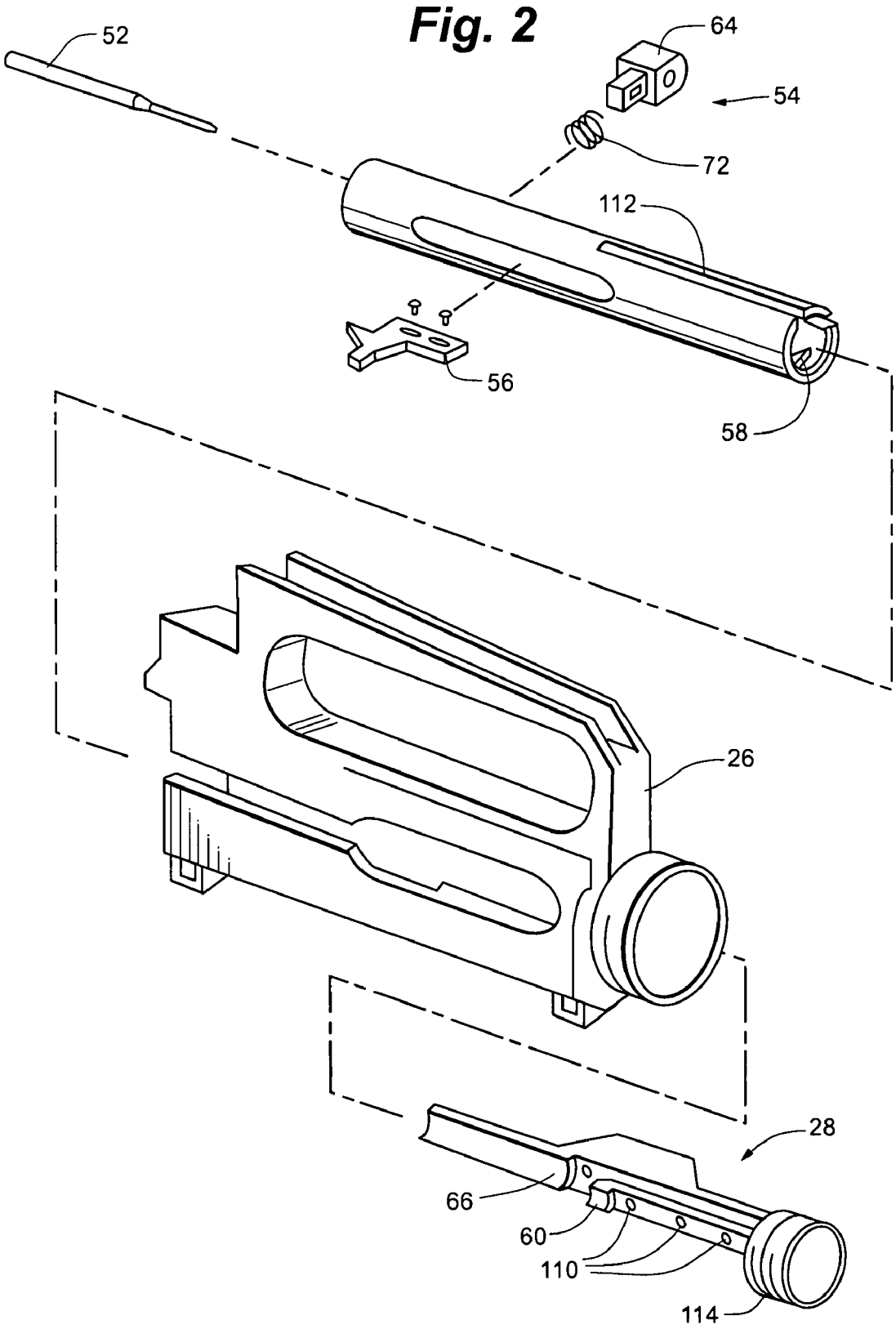
FIG. 2 is a detailed perspective exploded view of a portion of the embodiment of FIG. 1.
Figure 3:
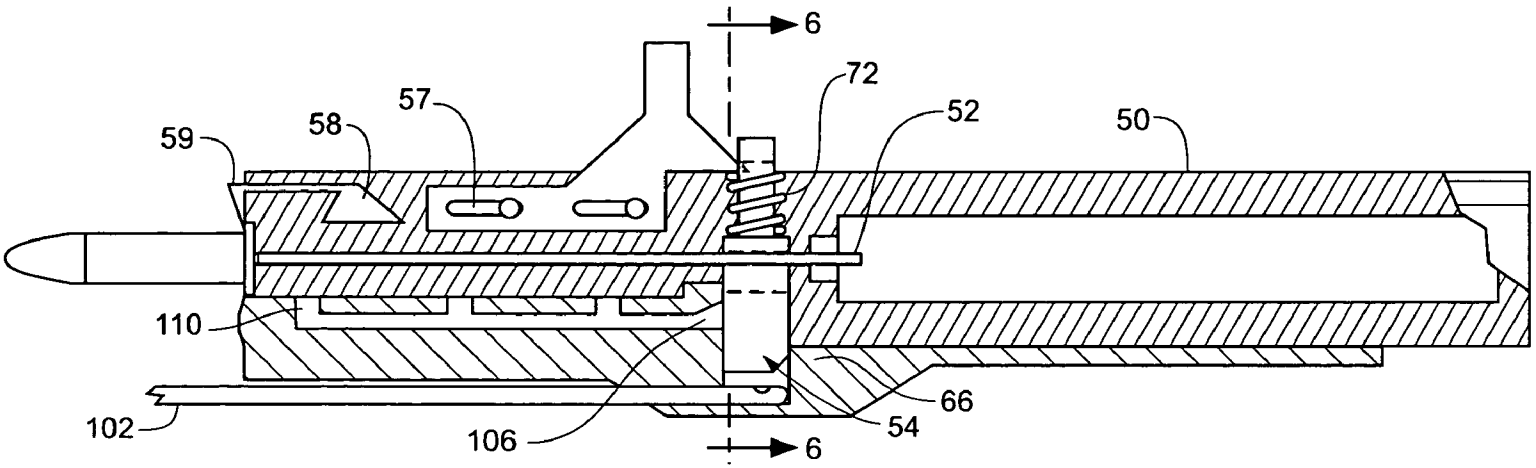
FIG. 3 is an overhead plan detailed cut-away view of a bolt, a locking mechanism, and a gas loop according to one embodiment of the present invention, wherein the bolt and locking mechanism are in a locked position.
Figure 4:
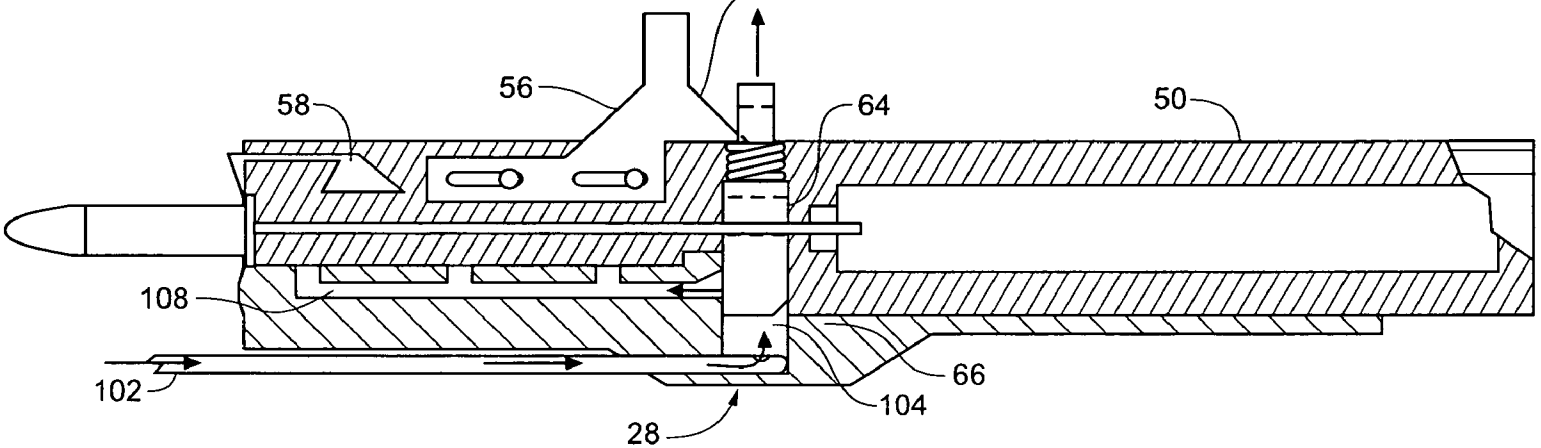
FIG. 4 is an overhead plan detailed cut-away view of the bolt and locking mechanism depicting the locking mechanism as it moves between the locked position and an unlocked position, according to one embodiment of the present invention.
Figure 5:
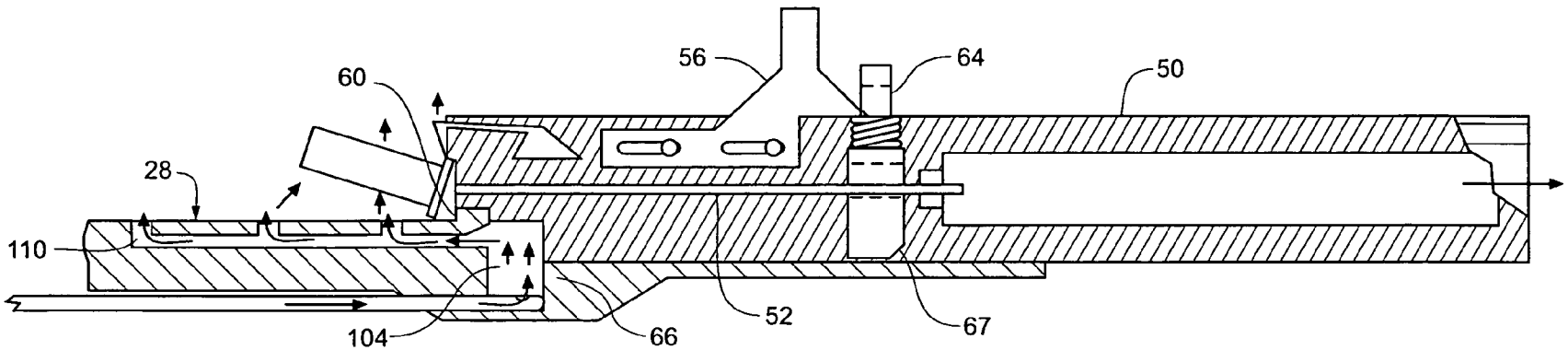
FIG. 5 is an overhead plan detailed cut-away view of the bolt and locking mechanism in an unlocked position.
Figure 6:
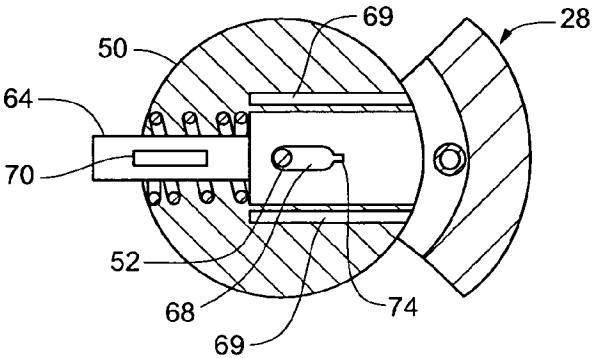
FIG. 6 is a cross-sectional front view of the bolt, the locking mechanism, and the gas loop taken along line 6-6 in FIG. 4, wherein the bolt and locking mechanism are in a locked position.

Upper receiver 26 is adapted to be releasably coupled to lower receiver 22, and referring to FIG. 2, upper receiver 26 generally includes major components bolt 50, a firing pin 52, a rearward locking mechanism 54, a manual assist 56, an extractor 58 and an ejector 60. In one embodiment, such components may be contained within a bolt carrier (not shown) that is within upper receiver 26.

Bolt 50 is slidably retained within upper receiver 26. In one embodiment, bolt 50 comprises a one-piece construction having a circular cross-section. Bolt 50 may also comprise a multi-piece construction or differently-shaped cross-section. In one embodiment, bolt 50 is D-shaped, having a generally circular cross-section and a flat portion. Bolt 50 may be constructed from steel, or high-strength alloys, or exotic metals such as titanium, or composites, or any combination thereof. In one embodiment, bolt 50 is constructed in whole or in part from carbon fiber, which is advantageous due to its excellent strength, light weight, performance in high temperature environments, and resistance to expansion under high temperatures.

Firing pin 52 is slidably held in bolt 50, such as by a hollow retaining nut that threads into bolt 50, or by a cotter pin, tension pin, or other arrangement that facilitates rapid disassembly for cleaning or repairs. Firing pin 52 is preferably releasably coupled to bolt 50 to facilitate rapid disassembly of firearm 20 such as for cleaning or repairs. Other suitable methods of securing firing pin 52 to bolt 50 will be apparent to one skilled in the art. On the distal end of firing pin 52, a spring 53 may be included. Spring 53 is configured to insure that after firing pin 52 strikes a cartridge, firing pin 52 translates rearward slightly, thereby preventing pin 52 from prematurely contacting a subsequent cartridge. Bolt 50 is configured to allow at least part of trigger assembly 32 to contact the proximate end of firing pin 52.

Referring now to FIGS. 3-6, locking mechanism 54 comprises a locking lug 64 and a locking reinforcement 66. Locking mechanism 54 is a rearward mechanism, such that the locking mechanism is rearwardly disposed on bolt 50, away from the breech. Lug 64 is slidably coupled to bolt 50, such that lug 64 can move from a locked position to an unlocked position. In one embodiment, lug 64 is slidably coupled within bolt 50. Lug 64 includes a central bore 68 through which firing pin 52 is disposed, and a distal slot 70 through which manual assist 58 communicates with locking lug 54. A locking spring 72 is included on lug 64 so as to bias lug 64 into a locked position. In one embodiment, lug 64 includes a channel 74 in central bore 68 to prevent debris build-up in bore 68 from interfering with proper functioning of locking mechanism 54. In the event that debris, such as carbon deposits, enters central bore 68, the debris is pushed into channel 74 when lug 64 moves from a locked position to an unlocked position, thereby allowing lug 64 to operate properly. In one embodiment depicted in FIG. 6, guides 69 may be provided on either side of locking lug 64 to reinforce and align lug 64 during operation. In one embodiment, locking reinforcement 66 may be integrated with gas operating system 28. In another embodiment, locking reinforcement 66 may be integrated with upper receiver 26.

Locking mechanism 54 includes a dedicated locking spring 72. In the present invention, locking spring 72 is configured to maintain locking mechanism 54 and bolt 50 in a locked position, while recoil spring is configured only to cycle the action of firearm 20. Thus, the tension of recoil spring can be adjusted solely for proper cycle action. Further, the tension of locking spring 72 can be adjusted solely to properly lock bolt 50. Additionally, locking reinforcement 66 may include a beveled edge 67 to assist locking lug 64 in moving locking mechanism 54 from a locked position to an unlocked position, and in moving from an unlocked position to a locked position. Beveled edge 67 in combination with locking lug 64 and locking spring 72 may also function as a type of forward assist. As bolt 50 recoils after firing and nears its locking position, beveled edge 67 on reinforcement 66 allows locking spring 72 to begin advancing locking lug 64 from its unlocked position to its locked position before bolt 50 has completed its travel.

Manual assist 56 may be on the top or either side of upper receiver 26, and in one embodiment acts as a charging handle. Assist 56 includes an engaging portion 76 that interacts with locking lug 64. In one embodiment, engaging portion 76 comprises a wedge that fits within distal slot 70 of lug 64. In the event locking mechanism 54 fails to unlock, a user can manually operate the firearm by pulling assist 56 rearward toward buttstock 34, thereby unlocking locking mechanism 54. In one embodiment, manual assist 56 includes one or more guides 57 that maintain alignment of manual assist 56 during use. In one embodiment, guides 57 ride on one or more pins or other similar structure coupled to bolt 50. Manual assist 56 may also act as a forward assist device for firearm 20. In the event that bolt 50 fails to return to a locked position during operation of firearm 20, a user can manually advance bolt 50 into a locked position by pushing forward on assist 56, thereby pushing guides 57 into the pins, causing bolt 50 to be advanced toward barrel 24.

Extractor 58 is preferably fixed to bolt 50, and functions to remove a spent cartridge from the breech after firing. In one embodiment, a proximal end of extractor 58 is fixed to bolt 50, while the distal end of extractor 58 is unfixed and includes a finger-like engagement portion 59 adapted to grasp the rim of a cartridge. Extractor 58 is constructed and configured such that distal end of extractor 58 is able to flex. During operation of firearm 20, extractor 58 must flex slightly to grasp a new cartridge as bolt 50 advances toward barrel 24. One skilled in the art will appreciate that the material for extractor 58 as well as the dimensions of extractor 58 will be selected to provide the proper flex depending on the desired application.

Extractor 58 may be secured on its proximal end by being pressed into bolt 50, and in one embodiment the proximal end comprises a dovetail shape. Other means of securing extractor 58 to bolt 50 will be appreciated by one skilled in the art, and may include the use of mechanical fasteners, pins and clips, or other press-fit arrangements.

In one embodiment, ejector 60 is fixed with respect to bolt 50. Ejector 60 is configured to interrupt the rearward travel of an empty cartridge by contacting the rim of the cartridge at a point between the primer and outer diameter of the cartridge. In one embodiment, ejector 60 is located on the left side of firearm 20, such that bolt 50 of the present invention can be integrated into a conventional M16-type rifle, which typically features an ejection port on the right side of the rifle.

Gas operating system 28 may be integrated, in whole or in part, with upper receiver 26, or may be releasably coupled to upper receiver 26. Gas operating system 28 is fluidly coupled to a port in the barrel 24 with a gas tube 102. Gas from a fired cartridge exits the port in barrel 24, into gas tube 102, and enters chamber 104 of gas operating system 28. Chamber 104 is in selective fluid communication with return loop 108, which leads to exit ports 110. In one embodiment, gas tube 102 is integrated alongside barrel 24, and gas tube 102 mates with gas operating system 28. Gas operating system 28 includes a threaded portion 114 for coupling to barrel 24. In one embodiment, ejector 60 is integrated into the structure of gas operating system 28.

While bolt 50 is in the locked position, locking lug 64 is engaged against locking reinforcement 66, and lug 64 is sealing off relief port 106. Locking spring 72 maintains lug 64 in the locked position. As bolt is coupled to lug 64, bolt 50 is prevented from moving while lug 64 is locked against reinforcement 66. The distal end or head of bolt 50 is intimately proximate to barrel 24, and the distal end of extractor 58 is grasping the cartridge. Manual assist 56 is fully forward, and if so equipped, guides 57 are engaged against pins in the bolt.

While in the unlocked position, lug 64 is disengaged from reinforcement 66, such that bolt 50 is free to translate in a longitudinal direction with respect to the firearm 20. Lug 64 moves laterally with respect to firearm 20 in its range of motion between the locked position and unlocked position. While unlocked, lug 64 translates with bolt 50 in the longitudinal direction. Upon unlocking, the gas flow path from gas tube 102 to relief port 106 is clear. Recoil spring may be partially or completely compressed, depending on the location of bolt 50.

Referring now to the operation of firearm 20, trigger assembly 32 is first activated which pushes firing pin 52 into a cartridge, firing a bullet. As the bullet exits barrel 24, high temperature and high pressure gas follows the projectile down barrel 24. Some of this gas enters a port in barrel in 24, and travels down gas tube 102 back toward upper receiver 26. As gas enters chamber 104 from gas tube 102, the gas pushes on locking lug 64 which is in a locked position. The pressure of the gas pushes lug 64 from the locked position to the unlocked position, compressing locking spring 72. In addition, the gasses acting on lug 64 prevent light freezing or sticking of locking mechanism 54. The movement of lug 64 from the locked position to an unlocked position causes lug 64 to clear locking reinforcement 66, allowing bolt 50 to translate rearward into buttstock 34, whereby bolt 50 hits and compresses action spring contained in buttstock 34. As bolt 50 translates rearward, engagement portion 59 of extractor 58 pulls the empty cartridge out of the breech. As lug 64 is moved clear of reinforcement 66, the gas in tube 102 begins to enter relief port 106, traveling into return loop 108 and on to one or more exit ports 110. As bolt 50 translates rearward, the empty cartridge is pulled into ejector 60, with ejector 60 contacting the cartridge at a point radially offset from the primer, thereby causing the longitudinal axis of the cartridge to rotate about ejector 60. At the same time, the gas traveling out of exit ports 110 acts on the side of the cartridge body to help eject the spent cartridge casing out of upper receiver 26. In one embodiment, the empty casing is ejected out a side port in upper receiver 26. The cartridge is ejected as bolt 50 is still traveling rearward.

The profile of relief port 106 is dictated in part by the relationship between locking lug 64 and reinforcement 66, so that gas coming from tube 102 does not start entering relief port 106 prior to lug 64 being fully moved to an unlocked position. Incorrect proportions between lug 64, reinforcement 66, and relief port 106 may cause premature dislodging of an empty cartridge after firing. One skilled in the art will recognize that many different combinations and/or arrangements of lug 64, reinforcement 66, and relief port 106 are possible, and are fully contemplated as being within the scope of the present invention.

In one embodiment, the above components can be arranged so as to utilize lightweight cartridges with a firearm 20 according to the present invention, such as plastic cartridges. A lightweight cartridge is susceptible to premature ejection when used in certain firearms. Gas pressure exiting from ports 110 may cause a lightweight empty cartridge to begin exiting the firearm prior to the cartridge contacting ejector 60. Proper adjustment of the configuration between lug 64, reinforcement 66, and relief port 106 allows lightweight cartridges to be used with the present invention.

After bolt 50 travels rearward into buttstock 34 and compresses action spring, bolt 50 changes direction and moves forward toward barrel 24 until locking lug 64 clears reinforcement 66 and locking spring 72 biases lug 64 into a locked position with lug 64 engaged against reinforcement 66. As bolt 50 moves back toward the locked position, distal end of extractor 58 flexes as extractor 58 encounters a new cartridge from magazine 38, such that engagement portion 59 grasps the new cartridge. In one embodiment, buttstock 34 may be modified such that the typical rubber bumpstop is replaced with a back-up spring of similar size but different spring constant. In such an embodiment, if bolt 50 should over-travel and fully compress action spring, back-up spring is configured to insure that bolt 50 fully returns back to its locked position.

In the present invention, bolt 50 maintains its orientation during operation, that is, bolt 50 does not rotate about a longitudinal axis of the firearm, as in other gas operating systems. In one embodiment, bolt 50 may include one or more features 112 that act to maintain the alignment of bolt 50 in upper receiver 26. For example, features 112 may comprise various rails, guides, or channels included in bolt 50 that correspond to protrusions in upper receiver 26, so that as bolt 50 translates during firing, features 112 in bolt 50 interact with the protrusions to keep bolt 50 aligned and stable within upper receiver 26. In one embodiment, bolt 50 includes protrusions to interact with channels in upper receiver 26. In another embodiment, the distal end (or head) of bolt 50 is configured to mate with the breech of barrel 24. In such an embodiment, the head of bolt 50 may be cupped to facilitate mating to barrel 24. In a further embodiment, bolt 50 is a tri-lock design, including a cupped distal end, one or more features on the rear of bolt 50, and locking mechanism 54.

The present invention is suitable for use in adverse conditions such as dirty, wet, or submerged conditions. In on embodiment, bolt 50 is configured to house lug 64, locking spring 72, firing pin 52, extractor 60, and manual assist 56 therein. Such an arrangement prevents dirt or other contaminants from entering bolt 50 and the components contained therein. Sealing these components within bolt 50 provides trouble-free operation of firearm 20 in extreme environments.

In the event that locking spring 72 should become jammed, damaged, or otherwise inoperable, a firearm 20 according to the present invention will still function properly. A user can manually operate manual assist 56 as a forward assist device as discussed above, so as to move locking mechanism 54 into a locked position, ready for firing. After activating trigger assembly 32, gas pressure will unlock lug 64 from locking reinforcement 54, thereby unlocking bolt 50.

The present invention allows for adjustment of the head spacing, that is, adjustment of the distance between distal end bolt 50 and the rear of barrel 24. In one embodiment, one or more spacers are provided at the junction between barrel 24 and bolt 50, and changing the thickness of the spacers can adjust the head spacing. In another embodiment, head spacing is adjusted by threading gas operating system 28 farther in to, or out of, barrel 24. In such an embodiment, the use of a removable gas block arrangement 120 may be necessary to allow proper alignment of gas tube 102 when adjusting the head spacing.

In such an embodiment wherein head spacing is adjusted by threading gas operating system 28, a removable gas block arrangement 120 is included on barrel 24. As gas operating system 28 is threaded into barrel 24 to adjust head spacing, its orientation may cause chamber 104 to become misaligned with gas tube 102.

As depicted in FIG. 1, gas block arrangement 120 includes a gas block 122, and optionally a fastener 124. Gas block 122 comprises a collar portion 126 and a tube coupling portion 128. Collar portion 126 is configured to slide onto barrel 24 and seal over a port in barrel 24. Tube coupling portion 128 connects to gas tube 102, and provides a gas communication path from barrel 24 to gas operating system 28. Gas block 122 functions analogously to a banjo fitting, such that gas block 122 is rotatable around barrel 24 while maintaining the gas communication path from barrel 24 to gas operating system. Fastener 124 may be used to secure gas block 122 against a handguard of the firearm.

The present invention can be adapted for use with firearms having a bull-pup design, by using a horizontal hammer and transfer bar positioned on top of the upper receiver so as to prevent over-travel on bolt return after firing. The recoil spring in such an embodiment may be attached to the transfer bar and used as a hammer spring along with a light spring behind the bolt. Additionally, the present invention is adaptable to many varieties of firearms, such as rifles, shotguns, and handguns.

Figure 7:
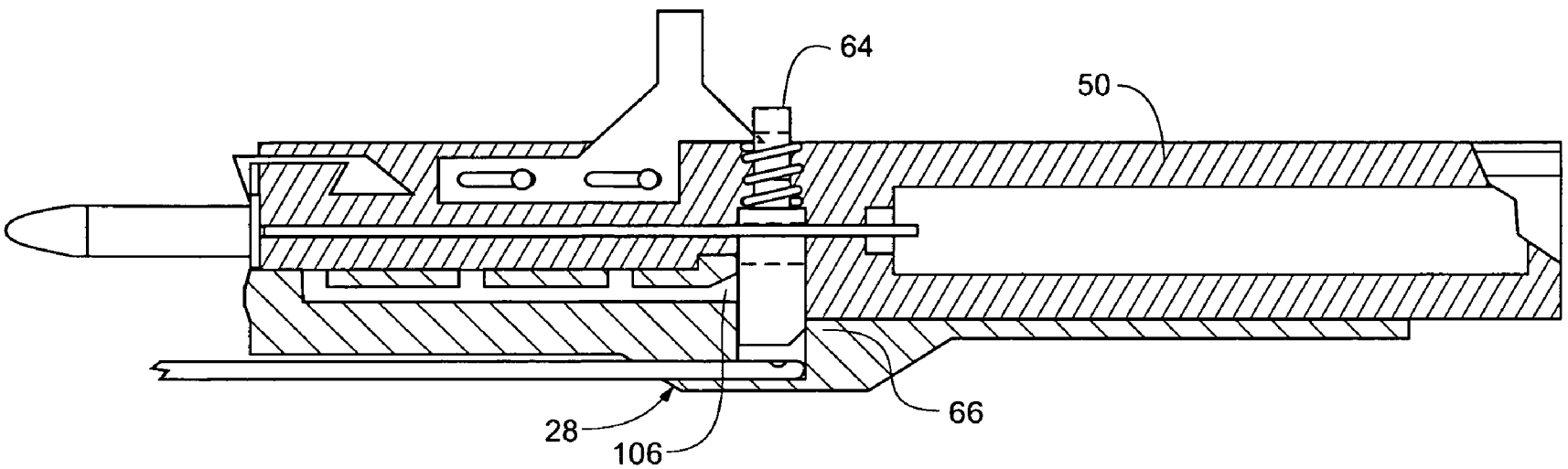
FIG. 7 is an overhead plan detailed cut-away view of a bolt, a locking mechanism, and a gas loop according to another embodiment of the present invention, wherein the bolt and locking mechanism are in a locked position.

Exact dimensions and tolerances of the various components of the present invention are not detailed herein, but it will be appreciated by one skilled in the art that the tolerances between the various components should be held tight so as to increase accuracy of the firearm as well as ensure smooth operation. Dimensions of the components and relationships between components will depend upon the desired application, and can be varied for use in different firearms or with different sized ammunition. For example, referring now to FIG. 7, the thickness of bolt 50 may be increased between locking lug 64 and the point where firing pin 52 is struck, so as to increase the strength of bolt 50 in that area. In addition, tolerances between components may differ depending on the material selected for the components. Due to the high temperatures experienced during operation of firearm 20, components in upper receiver 26 should be of a material selected to limit expansion beyond acceptable limits, especially during automatic or semi-automatic fire.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A firearm, comprising:

a bolt, translatable along a longitudinal axis of the firearm;

a locking lug adapted to restrict translation of the bolt along the longitudinal axis, the lug laterally shiftable with respect to the longitudinal axis, the locking lug in direct impingement fluid communication with a port in the barrel of the firearm, the locking lug adapted to be moved by fired cartridge gas from a locked position to an unlocked position; and a reinforcement portion of the firearm, fixed against translation along the longitudinal axis with respect to the bolt, the locking lug to engage the reinforcement portion in the locked position, wherein, in the locked position the lug interferes with the reinforcement portion such that the bolt is restrained from moving longitudinally along the longitudinal axis of the firearm, and in the unlocked position the bolt is free to longitudinally translate within along the longitudinal axis of the firearm.

2. The firearm of claim 1, the bolt including one or more alignment features adapted to maintain rotational orientation of the bolt during operation of the firearm.

3. The firearm of claim 1, wherein the locking lug is biased toward a locked position.

4. The firearm of claim 1, wherein the locking lug is integrated with the bolt.

5. The firearm of claim 1 further comprising a manual assist coupled to the bolt, the manual assist configured to release the locking mechanism from the locked position.

6. The firearm of claim 5, wherein the manual assist comprises a forward assist device configured to engage the locking mechanism in a locked position.

7. The firearm of claim 1 further comprising a gas operating system, configured to communicated gas means from the barrel of the firearm to the locking mechanism.

8. The firearm of claim 7, wherein the gas operating system includes one or more exit ports adapted to eject an empty ammunition cartridge, the exit ports selectively communicable with the gas means such that when the locking mechanism is in the locked position, the exit ports are not communicable with the gas means, and when the locking mechanism is in the unlocked position, the exit ports are communicable with the gas means.

9. The firearm of claim 1 further comprising a rotatable gas block coupled to the barrel of the firearm, the gas block fluidly coupling a source of the gas means to the locking lug.

10. The firearm of claim 1 further comprising an integrated ejector fixed with respect to the bolt.

11. The firearm of claim 1, wherein the bolt is slidably disposed in a receiver and the reinforcement portion of the firearm is part of a gas block disposed in the receiver.

12. A firearm, comprising:

a bolt adapted to slide along a longitudinal axis of the firearm;

a locking reinforcement fixed with respect to the bolt of the firearm; and a locking lug slidably coupled to the bolt, the lug in fluid communication with a port in the barrel of the firearm and moveable by directly impinging fired cartridge gas from a locked position in which the lug is secured against the reinforcement such that movement of the bolt is prevented, to an unlocked position in which the lug is clear of the reinforcement such that the bolt is free to translate along the longitudinal axis of the firearm.

13. The rearward locking mechanism of claim 12, wherein the locking lug is biased toward a locked position.

14. The rearward locking mechanism of claim 12, wherein the locking lug includes a beveled edge to assist the locking lug in moving from an unlocked to a locked position and from a locked position to an unlocked position.

15. The rearward locking mechanism of claim 12, wherein the locking lug is adapted to communicate with a manual assist being configured to release the locking mechanism from the locked position by engaging with the locking lug.

16. A bolt for a direct impingement gas operated firearm, comprising:

a locking lug coupled to the bolt and adapted to selectively maintain the bolt in a locked position in which the bolt is restricted from translation within a portion of the firearm and to laterally translate to an unlocked position in which the bolt is free to translate in the portion of the firearm, wherein the locking lug is couplable to a direct impingement gas port of the firearm and is adapted to be moved to the unlocked position by fired cartridge gas;

a flexible shell extractor adapted to deform to grasp a cartridge to remove the cartridge from a breech of the firearm after firing while the locking lug is in the unlocked position; and at least one guide adapted to maintain a rotational alignment of the bolt with respect to the receiver while in both the locked position and the unlocked position during operation, wherein the bolt is translatable along a longitudinal axis of the firearm when the rearward locking mechanism is in the unlocked position.

17. The bolt of claim 16, further comprising a manual assist configured to release the locking mechanism from a locked position.

18. The bolt of claim 17, wherein the manual assist comprises a forward assist device configured to engage the locking mechanism in a locked position.

19. A method, comprising:

grasping a cartridge with an extractor;

translating a bolt longitudinally and mating the bolt to a breech such that the cartridge is disposed in the breech;

locking the bolt against the breech by laterally translating a shiftable locking lug into a locked position; and directly impinging spent cartridge gas onto the locking lug and laterally translating the shiftable locking lug to unlock the bolt.

20. The method of claim 19, including:

extracting the empty cartridge from the breech;

pulling the cartridge into contact with an ejector;

ejecting the cartridge from the firearm;

impacting the bolt into a recoil spring;

changing direction of the bolt and translating the bolt forward;

engaging a further cartridge as the bolt translates forward; and locking the bolt against the breech with the further cartridge in the breech by laterally translating the shiftable locking lug into the locked position.

* * * * *

UNITED STATES PATENT AND TRADEMARK OFFICE

CERTIFICATE OF CORRECTION

PATENT NO. : 7,874,240 B2
APPLICATION NO. : 11/821792
DATED : January 25, 2011
INVENTOR(S) : Brian Akhavan It is certified that error appears in the above-identified patent and that said Letters Patent is hereby corrected as shown below:

In column 9, line 5, in Claim 1, after "translate" delete "within".

In column 10, line 43, in Claim 20, after "the" delete "empty".

Signed and Sealed this
Twenty-second Day of March, 2011

David J. Kappos

David J. Kappos
*Director of the United States Patent and Trademark Office*